US008654042B2

(12) United States Patent
Sugimoto et al.

(10) Patent No.: US 8,654,042 B2
(45) Date of Patent: Feb. 18, 2014

(54) DISPLAY APPARATUS AND DISPLAY DRIVING METHOD

(75) Inventors: Hideki Sugimoto, Kanagawa (JP); Naobumi Toyomura, Kanagawa (JP)

(73) Assignee: Sony Corporation, Tokyo (JP)

( * ) Notice: Subject to any disclaimer, the term of this patent is extended or adjusted under 35 U.S.C. 154(b) by 273 days.

(21) Appl. No.: 12/985,386

(22) Filed: Jan. 6, 2011

(65) Prior Publication Data

US 2011/0169804 A1 Jul. 14, 2011

(30) Foreign Application Priority Data

Jan. 14, 2010 (JP) ..... 2010-005964

(51) Int. Cl.
*G09G 3/30* (2006.01)

(52) U.S. Cl.
USPC ..... 345/76; 345/77; 345/204; 315/169.3

(58) Field of Classification Search
USPC ..... 345/76–78, 204, 205, 211, 212; 315/169.3
See application file for complete search history.

(56) References Cited

U.S. PATENT DOCUMENTS

| | | | | |
|---|---|---|---|---|
| 2004/0046164 | A1 | 3/2004 | Kobayashi et al. | |
| 2005/0206590 | A1 | 9/2005 | Sasaki et al. | |
| 2008/0030437 | A1 * | 2/2008 | Iida et al. | 345/80 |
| 2008/0158110 | A1 * | 7/2008 | Iida et al. | 345/76 |
| 2009/0122047 | A1 * | 5/2009 | Yamamoto et al. | 345/211 |
| 2009/0135174 | A1 * | 5/2009 | Yamamoto et al. | 345/213 |
| 2009/0251493 | A1 | 10/2009 | Uchino et al. | |
| 2009/0295785 | A1 * | 12/2009 | Yamamoto et al. | 345/214 |

FOREIGN PATENT DOCUMENTS

| | | |
|---|---|---|
| JP | 2003-255856 | 9/2003 |
| JP | 2003-271095 | 9/2003 |
| JP | 2007-133282 | 5/2007 |
| JP | 2009-139928 | 6/2009 |
| JP | 2009-157019 | 7/2009 |
| JP | 2009-186583 | 8/2009 |
| JP | 2009-271320 | 11/2009 |

* cited by examiner

*Primary Examiner* — Koosha Sharifi-Tafreshi
(74) *Attorney, Agent, or Firm* — Dentons US LLP

(57) ABSTRACT

A display apparatus includes: a pixel array in which pixel circuits each having a light emitting device, a drive transistor, a sampling transistor, and a retention capacity; a signal selector that supplies threshold correction reference voltages and a video signal voltages as to signal lines arranged in columns on the pixel array; a drive control scanner that provides power supply pulses to power supply control lines arranged in rows on the pixel array and applies drive voltages to the drive transistors; and a write scanner that provides scan pulses to write control lines arranged in rows on the pixel array to control the sampling transistors and executes input of the threshold correction reference voltages and the video signal voltages to the pixel circuits, and brings the sampling transistors into conduction by the scan pulses at plural times when the signal line voltages are the threshold correction reference voltages in order to execute plural threshold corrections in non-emission periods of one light emission cycles of the pixels circuits.

5 Claims, 9 Drawing Sheets

LT1:QUENCH

LT0:PREVIOUS LIGHT EMISSION

LT3:THRESHOLD CORRECTION

LT2:PREPARATION FOR THRESHOLD CORRECTION

LT4:WRITING + MOBILITY CORRECTION

LT5:LIGHT EMISSION

DISPLAY APPARATUS AND DISPLAY DRIVING METHOD

BACKGROUND OF THE INVENTION

1. Field of the Invention

The present invention relates to a display apparatus having a pixel array in which pixel circuits are arranged in a matrix and a display driving method therefor, and, for example, relates to a display apparatus using organic electroluminescence devices (organic EL devices) as light emitting devices.

2. Description of the Related Art

For example, as disclosed in JP-A-2003-255856 and JP-A-2003-271095, image display apparatuses using organic EL devices for pixels have been developed. Since the organic EL devices are self-emitting devices, the apparatuses have advantages that visibility of images is higher, backlighting is not necessary, the response speed is higher, etc. compared to a liquid crystal display, for example. Further, the brightness levels (gray levels) of the respective light emitting devices can be controlled by the values of currents flowing therein (so-called current-controlled type).

In an organic EL display, like the liquid crystal display, there are a simple matrix system and an active matrix system as driving systems therefor. The former is simple in structure, however, has a problem that realization of a large and high-definition display is difficult or the like, and thus, currently, the active matrix system is actively developed. This system is to control the currents flowing in the light emitting devices within the respective pixel circuits using active devices (generally, thin-film transistors: TFTs) provided within the pixel circuits.

SUMMARY OF THE INVENTION

For the pixel circuit configuration using organic EL devices, improvements in display quality by removing brightness irregularities with respect to each pixel or the like, upsizing of a panel, higher brightness, higher definition, higher frame rate (higher frequency), etc. are strongly demanded.

In view of the demands, various kinds of configurations are being studied. For example, as in JP-A-2007-133282, various proposals for a pixel circuit configuration and operation that can remove the brightness irregularities with respect to each pixel by cancelling variations of the threshold voltages and mobility of the drive transistors with respect to each pixel have been made.

Thus, it is desirable to realize a pixel circuit operation preferable for speeding up by higher frequency, driving at a speed many times higher, or the like as a display apparatus using organic EL devices.

A display apparatus according to an embodiment of the invention includes a pixel array in which pixel circuits each having a light emitting device, a drive transistor that applies a current in response to a gate-source voltage to the light emitting device when a drive voltage is applied to a drain and the source, a sampling transistor that inputs a signal line voltage to the gate of the drive transistor when being brought into conduction, and a retention capacity that is connected between the gate and the source of the drive transistor and holds a threshold voltage of the drive transistor and an input video signal voltage are arranged in a matrix, a signal selector that supplies threshold correction reference voltages and the video signal voltages as the signal line voltages to respective signal lines arranged in columns on the pixel array, a drive control scanner that provides power supply pulses to respective power supply control lines arranged in rows on the pixel array and applies drive voltages to the drive transistors of the pixel circuits, and a write scanner that provides scan pulses to respective write control lines arranged in rows on the pixel array to control the sampling transistors of the pixel circuits and executes input of the threshold correction reference voltages and the video signal voltages to the respective pixel circuits, and brings the sampling transistors into conduction by the scan pulses at plural times when the signal line voltages are the threshold correction reference voltages in order to execute plural threshold corrections in non-emission periods of one light emission cycles of the respective pixels circuits. Further, pre-bootstrap that raises a source voltage and a gate voltage of the drive transistor is executed in a predetermined period immediately before start of the first threshold correction in the plural threshold corrections.

The pre-bootstrap is executed by the drive control scanner applying the drive voltage in the predetermined period immediately before the write scanner brings the sampling transistor into conduction by the scan pulse for the first threshold correction.

A display driving method of an embodiment of the invention includes the steps of bringing the sampling transistors into conduction by the scan pulses at plural times using the write scanner when the signal line voltages are the threshold correction reference voltages in order to execute plural threshold corrections in non-emission periods of one light emission cycles of the respective pixels circuits, and executing pre-bootstrap that raises a source voltage and a gate voltage of the drive transistor in a predetermined period immediately before start of the first threshold correction in the plural threshold corrections.

That is, in the embodiments of the invention, in order to take the threshold correction operation period longer even when the high speed driving by the higher frame rate or the like is performed, plural threshold corrections are performed in the respective pixel circuits in one light emission cycles. In this regard, when the pixel circuit driving becomes faster, one threshold correction period must become shorter. Then, at the first threshold correction, the gate-source voltage of the drive transistor is not sufficiently smaller. At the end of the first threshold correction, the larger the gate-source voltage, the higher the speed of bootstrap in the pause period to the second threshold correction operation. Thereby, the gate-source voltage of the drive transistor becomes the threshold voltage or less and the threshold correction operation becomes easier to fail, and the margin of the threshold correction decreases.

Accordingly, pre-bootstrap is executed before the start of the first threshold correction operation. Thereby, the source voltage is raised to some degree, and the gate-source voltage of the drive transistor is appropriately made smaller at the first threshold correction. Then, the amount of bootstrap of the next pause period may be suppressed and the failure of the threshold correction operation due to excessively large bootstrap may be prevented.

According to the embodiments of the invention, in the system of performing plural threshold correction operations, the phenomenon that the gate-source voltage of the drive transistor becomes smaller than the threshold voltage and the threshold correction operation fails may be prevented by bootstrap. Thereby, also, in the case of the faster driving at the driving speed many times higher or the like, the margin of threshold correction may be enlarged and both speeding up and improvements in image quality by realization of appropriate threshold correction operation may be balanced.

DESCRIPTION OF PREFERRED EMBODIMENTS

As below, an embodiment of the invention will be explained in the following order.

[1. Configurations of Display Apparatus and Pixel Circuit]

[2. Pixel Circuit Operation Considered in Process Reaching the Invention: Divisional Threshold Correction]

[3. Pixel Circuit Operation of Embodiment]

[1. Configurations of Display Apparatus and Pixel Circuit]

Figure 1:
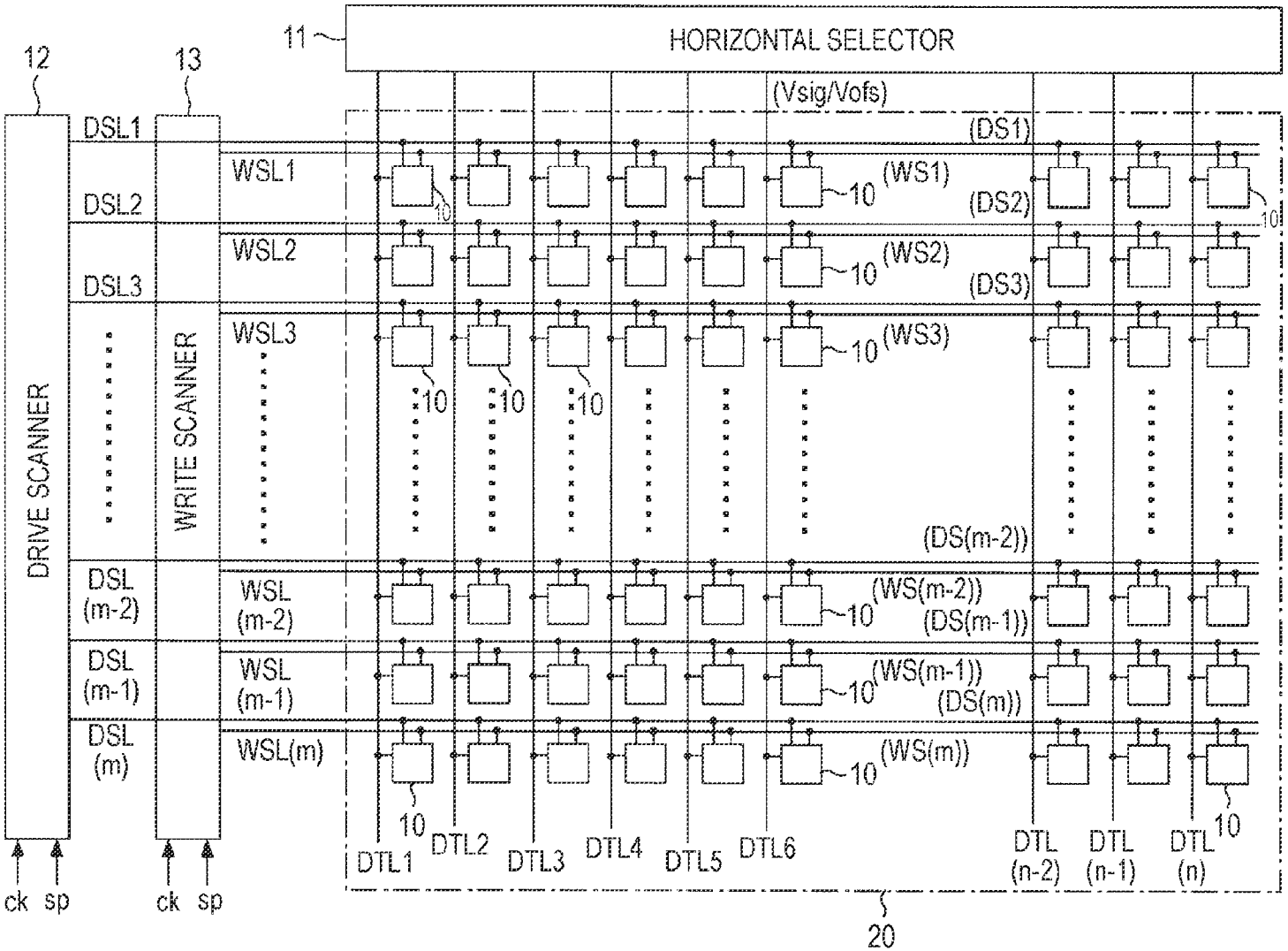
FIG. 1 is an explanatory diagram of a configuration of a display apparatus of an embodiment of the invention.

FIG. 1 shows a configuration of an organic EL display apparatus of an embodiment.

The organic EL display apparatus includes pixel circuits 10 using organic EL devices as light emitting devices and performing light emission driving using an active matrix system.

As shown in the drawing, the organic EL display apparatus has a pixel array 20 in which many pixel circuits 10 are arranged in a row direction and a column direction in a matrix (m rows×n columns). Each of the pixel circuits 10 is one of light emitting pixels of R (red), G (green), B (blue), the pixel circuits 10 of the respective colors are arranged with predetermined regularity, and thereby, a color display apparatus is formed.

As a configuration for light emission driving of the respective pixel circuits 10, a horizontal selector 11, a drive scanner 12, and a write scanner 13 are provided.

Further, signal lines DTL1, DTL2, . . . , DTL(n) selected by the horizontal selector 11 for supplying voltages to the pixel circuits 10 in response to signal values (gray level values) of brightness signals as display data are arranged in the column direction on the pixel array. The signal lines DTL1, DTL2, . . . , DTL(n) are provided in the number of columns (n columns) of the pixel circuits 10 arranged in the matrix in the pixel array 20.

Furthermore, on the pixel array 20, writing control lines WSL1, WSL2, . . . , WSL(m) and power supply control lines DSL1, DSL2, . . . , DSL(m) are arranged in the row direction. These writing control lines WSL and the power supply control lines DSL are respectively provided in the number of rows (m rows) of the pixel circuits 10 arranged in the matrix in the pixel array 20.

The writing control lines WSL (WSL1 to WSL(m)) are driven by the write scanner 13.

The write scanner 13 sequentially supplies scan pulses WS (WS1, WS2, . . . , WS(m)) to the respective writing control lines WSL1 to WSL(m) arranged in rows at predetermined preset times, and line-sequentially scan the pixel circuits 10 row by row.

The power supply control lines DSL (DSL1 to DSL(m)) are driven by the drive scanner 12. The drive scanner 12 supplies power supply pulses DS (DS1, DS2, . . . , DS(m)) to the respective power supply control lines DSL1 to DSL(m) arranged in rows according to the line-sequential scan by the write scanner 13. The power supply pulses DS (DS1, DS2, . . . , DS(m)) are pulse voltages switched between two values of a drive voltage Vcc and an initial voltage Vini.

The drive scanner 12 and the write scanner 13 set timing of the scan pulses WS and the power supply pulses DS based on clocks ck and start pulses sp.

The horizontal selector 11 supplies signal line voltages as input signals for the pixel circuits 10 to the signal lines DTL1, DTL2, . . . arranged in the column direction according to the line-sequential scan by the write scanner 13.

In the embodiment, the horizontal selector 11 supplies threshold correction reference voltages Vofs and video signal voltages Vsig as the signal line voltages to the respective signal lines.

In the display apparatus of the embodiment, an example of a signal selector in the appended claims is the horizontal selector 11, an example of a drive control scanner is the drive scanner, and an example of a write scanner is the write scanner 13.

Figure 2:
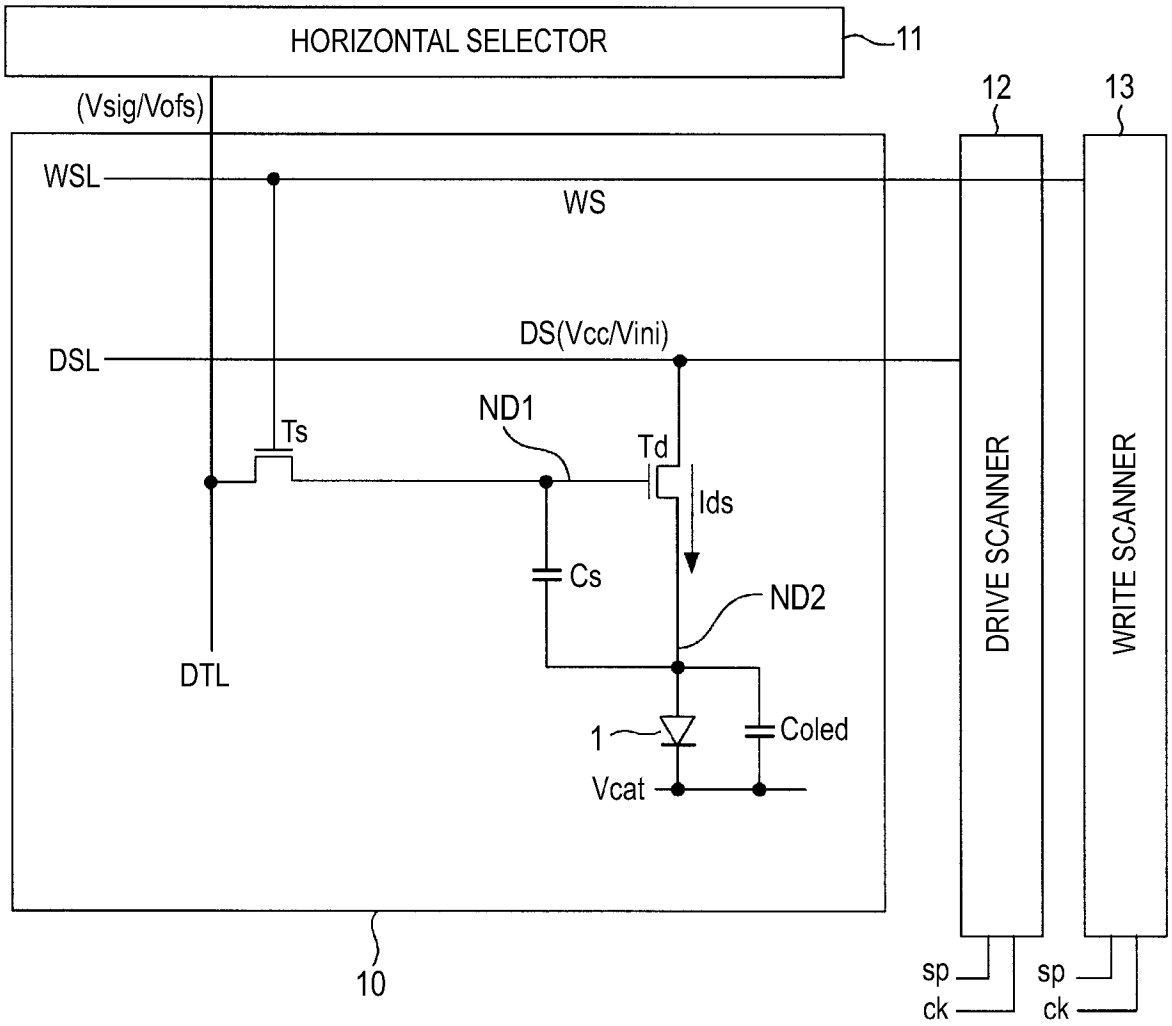
FIG. 2 is a circuit diagram of a pixel circuit of the embodiment.

FIG. 2 shows a configuration example of the pixel circuit 10. The pixel circuits 10 are arranged in a matrix as the pixel circuits 10 in the configuration of FIG. 1.

For simplicity, FIG. 2 shows only one pixel circuit 10 provided in a part in which the signal line DTL, the writing control line WSL, and the power supply control line DSL intersect.

The pixel circuit 10 includes an organic EL device 1 as a light emitting device, a retention capacity Cs, a sampling transistor Ts, and an n-channel thin-film transistor (TFT) as a drive transistor Td. A capacity Coled is a parasitic capacity of the organic EL device 1.

The retention capacity Cs has one terminal connected to the source (node ND2) of the drive transistor Td and the other terminal connected to the gate (node ND1) of the same drive transistor Td.

The light emitting device of the pixel circuit 10 is the organic EL device 1 having a diode structure, for example, and has an anode and a cathode. The anode of the organic EL device 1 is connected to the source of the drive transistor Td and the cathode is connected to a predetermined wire (cathode potential Vcat).

The sampling transistor Ts has one end of its drain and source connected to the signal line DTL and the other end connected to the gate of the drive transistor Td.

Further, the gate of the sampling transistor Ts is connected to the writing control line WSL.

The drain of the drive transistor Td is connected to the power control line DSL.

The light emission driving of the organic EL device 1 is basically as follows.

At the time when the video signal voltage Vsig is applied to the signal line DTL, the sampling transistor Ts is brought into conduction by the scan pulse WS provided from the write scanner 13 by the writing control line WSL. Thereby, the video signal voltage Vsig from the signal line DTL is written in the retention capacity Cs.

The drive transistor Td allows a current Ids to flow in the organic EL device 1 by the current supply from the power control line DSL provided with the drive potential Vcc by the drive scanner 12, and allows the organic EL device 1 to emit light.

In this regard, the current Ids takes a value in response to a gate-source voltage Vgs of the drive transistor Td (value in response to the voltage retained in the retention capacity Cs), and the organic EL device 1 emits light with brightness in response to the current value.

That is, in the case of the pixel circuit 10, the gate application voltage of the drive transistor Td is changed by writing of the video signal voltage Vsig from the signal line DTL in the retention capacity Cs, and thereby, the current value flowing in the organic EL device 1 is controlled and the gray level of light emission is obtained.

Since the drive transistor Td is designed to constantly operate in a saturated region, the drive transistor Td serves as a constant-current source having a value shown in the following equation.

$$Ids=(1/2)\cdot\mu\cdot(W/L)\cdot Cox\cdot(Vgs-Vth)^2 \quad (1)$$

Ids indicates a current flowing between the drain and the source of the transistor operating in the saturated region, μ indicates mobility, W indicates a channel width, L indicates a channel length, Cox indicates a gate capacity, and Vth indicates a threshold voltage of the drive transistor Td.

As is clear from the equation (1), the drain current Ids is controlled by the gate-source voltage Vgs in the saturated region. Since the gate-source voltage Vgs is held constant, the drive transistor Td operates as a constant-current source and can allow the organic EL device 1 to emit light with constant brightness.

In this manner, basically, in each frame period, the operation of writing the video signal voltage (gray level value) Vsig in the retention capacity Cs is performed in the pixel circuit 10, and thereby, the gate-source voltage Vgs of the drive transistor Td is determined in response to the gray level to be displayed.

Further, the drive transistor Td functions as a constant-current source for the organic EL device 1 by operating in the saturated region, allows a current in response to the gate-source voltage Vgs to flow in the organic EL device 1, and thereby, light is emitted with brightness in response to the gray level value of the video signal in the organic EL device 1 in each frame period.

[2. Pixel Circuit Operation Considered in Process Reaching the Invention: Divisional Threshold Correction]

Here, for understanding of the invention, a pixel circuit operation considered in the process reaching the invention will be explained. This is the circuit operation including a threshold correction operation and a mobility correction operation for compensation for uniformity deterioration due to variations in threshold values and mobility of the drive transistors Td of the respective pixel circuits 10. Specifically, as the threshold correction operation, an example of performing divisional threshold correction divisionally performed at plural times within a period of one light emission cycle is shown.

In the pixel circuit operation, the threshold correction operation and the mobility correction operation themselves have been performed in related art, and their necessity will briefly be explained.

For example, in a pixel circuit using a polysilicon TFT or the like, the threshold voltage Vth of the drive transistor Td and the mobility μ of the semiconductor thin film forming the channel of the drive transistor Td may change over time. Further, the transistor characteristics of the threshold voltages Vth and the mobility μ may vary from pixel to pixel due to variations in the manufacturing process.

When the threshold voltages Vth and the mobility μ of the drive transistors Td vary from pixel to pixel, the current values flowing in the drive transistors Td vary from pixel to pixel. Accordingly, if the same video signal value (video signal voltage Vsig) is provided to all pixel circuits 10, light emission brightness of the organic EL device 1 varies from pixel to pixel and, as a result, screen uniformity is degraded.

On this account, in the pixel circuit operation, a correction function for variations of the threshold voltages Vth and the mobility μ is provided.

Figure 3:
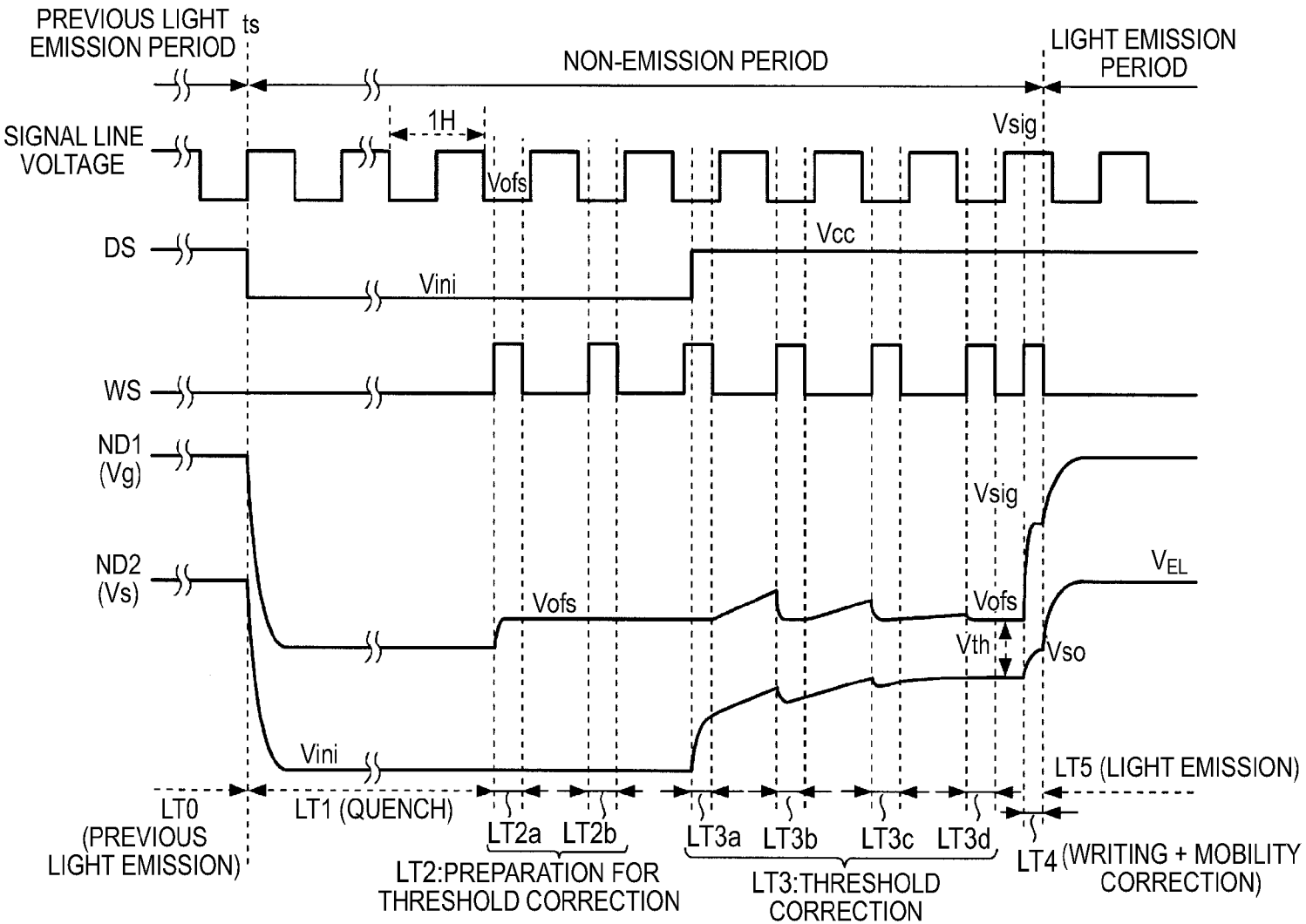
FIG. 3 is an explanatory diagram of a pixel circuit operation in the case where divisional threshold correction is performed.

FIG. 3 shows a timing chart of an operation of one light mission cycle (one frame period) of the pixel circuit 10.

In FIG. 3, the signal line voltage that the horizontal selector 11 provides to the signal line DTL is shown. In the case of the operation example, the horizontal selector 11 provides a pulse voltage as the threshold correction reference voltage Vofs and the video signal voltage Vsig to the signal line DTL as the signal line voltage in one horizontal period (1H).

Further, in FIG. 3, a power supply pulse DS supplied from the drive scanner 12 via the power control line DSL is shown. As the power supply pulse DS, the drive voltage Vcc or the initial voltage Vini is provided.

Furthermore, in FIG. 3, the scan pulse WS provided to the gate of the sampling transistor Ts by the write scanner 13 via the writing control line WSL is shown. The n-channel sampling transistor Ts is brought into conduction when the scan pulse WS is set to H-level, and into no conduction when the scan pulse WS is set to L-level.

In addition, in FIG. 3, changes of the gate voltage Vg and the source voltage Vs of the drive transistor Td are shown as the voltages of the nodes ND1, ND2 shown in FIG. 2.

A time point ts in the timing chart of FIG. 3 is start timing of one cycle in which the organic EL device 1 as the light emitting device is driven to emit light, for example, one frame period of image display.

Figure 5B:
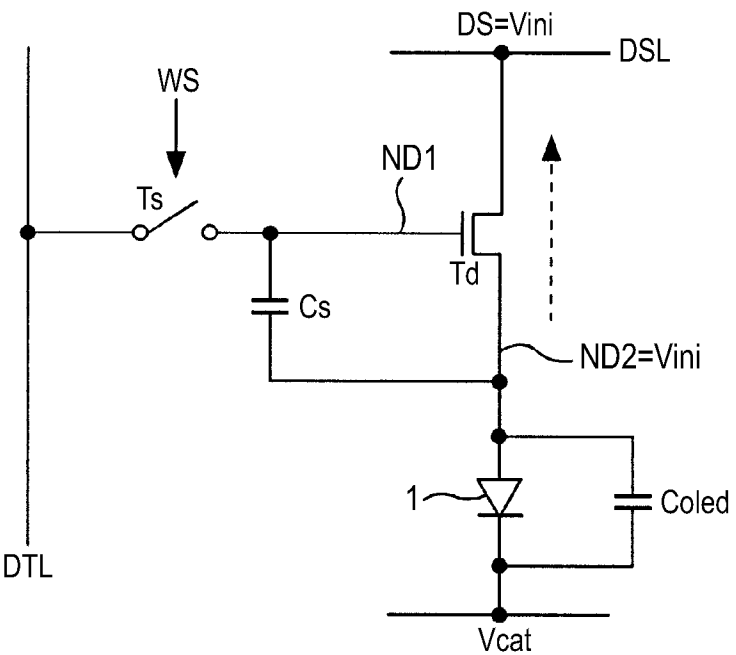
FIGS. 5A and 5B are equivalent circuit diagrams of a process of one cycle of light emission operation of the pixel circuit.
Figure 5A:
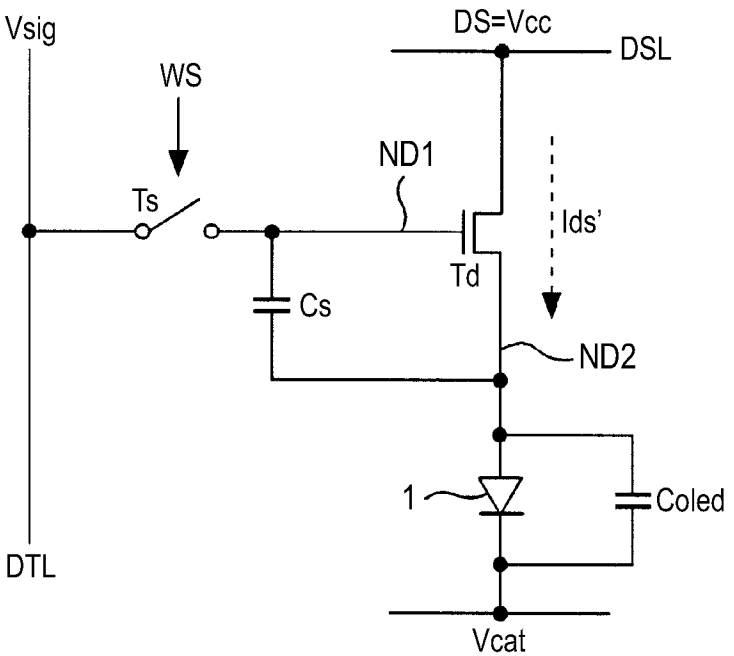

Before the time point ts (period LT0), light emission for the previous frame is performed. An equivalent circuit of the period LT0 is shown in FIG. 5A.

That is, the light emission state of the organic EL device 1 is a state in which the power supply pulse DS is at the drive voltage Vcc and the sampling transistor Ts is off. At this time, the drive transistor Td is set to operate in the saturated region, and thus, a current Ids' flowing in the organic EL device 1 takes a value shown in the above described equation (1) in response to the gate-source voltage Vgs of the drive transistor Td.

At the time point ts, the operation for light emission in this frame is started.

First, the power supply pulse DS is set to the initial potential Vini. FIG. 5B shows an equivalent circuit of a period LT1.

In this period, the initial potential Vini is smaller than a sum of a threshold voltage Vthe1 and the cathode voltage Vcat of the organic EL device 1, that is, Vini≤Vthe1+Vcat, and thus, the organic EL device 1 is quenched and a non-emission period is started. At this time, the power supply control line DSL serves as the source of the drive transistor Td. Further, the anode (node ND2) of the organic EL device 1 is charged to the initial potential Vini.

Figure 6B:
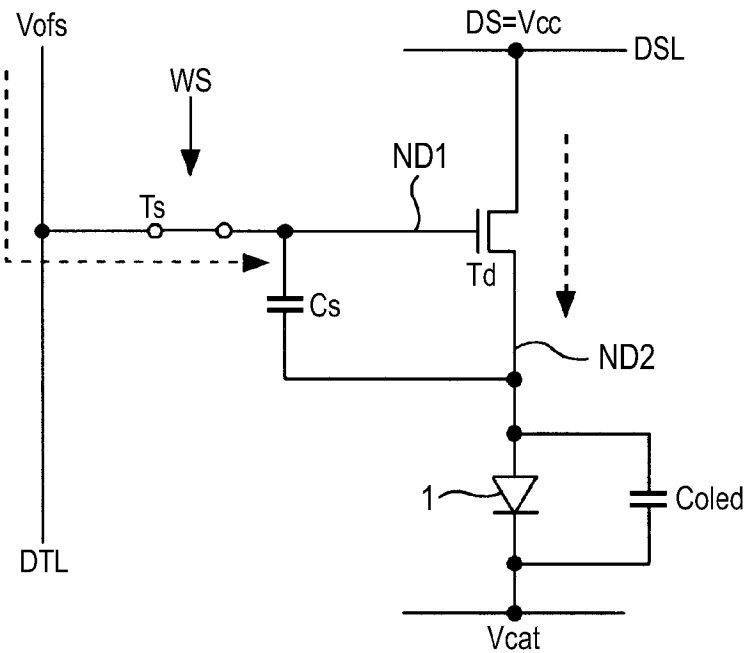
FIGS. 6A and 6B are equivalent circuit diagrams of the process of one cycle of light emission operation of the pixel circuit.
Figure 6A:
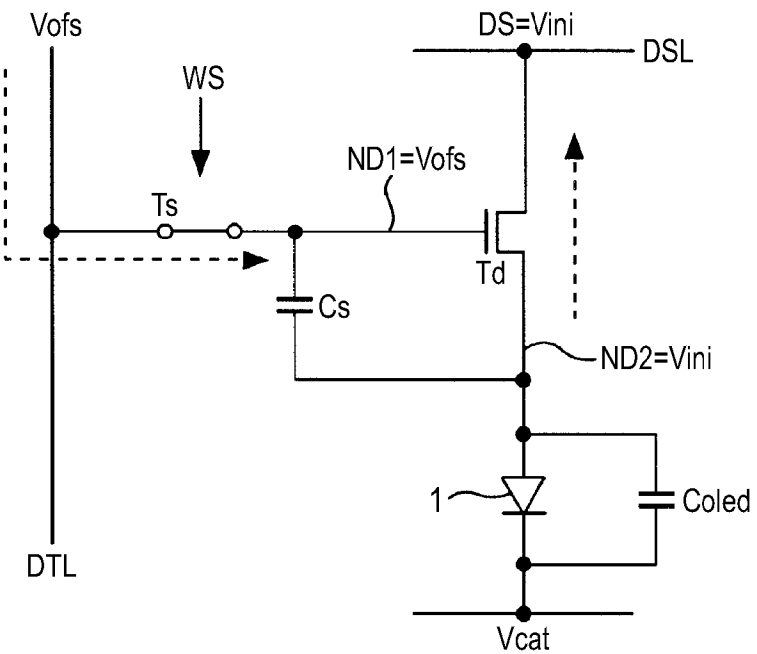

After a fixed period, preparation for threshold correction is made (periods LT2*a*, LT2*b*). An equivalent circuit is shown in FIG. 6A.

That is, in the periods LT2*a*, LT2*b*, when the potential of the signal line DTL becomes the threshold correction reference voltage Vofs, the scan pulse WS is set to H-level, and the sampling transistor Ts is turned on. The gate (node ND1) of the drive transistor Td is at the threshold correction reference voltage Vofs.

The gate-source voltage Vgs of the drive transistor Td becomes (Vofs−Vini).

It may be impossible to perform the threshold correction operation if the (Vofs−Vini) is not larger than the threshold voltage Vth of the drive transistor Td, and thus, the initial potential Vini and the threshold correction reference voltage Vofs are set to satisfy (Vofs−Vini)>Vth.

That is, as preparation of threshold correction, the gate-source voltage of the drive transistor is made sufficiently larger than the threshold voltage Vth.

Subsequently, threshold correction (Vth correction) is performed. Here, an example of four threshold corrections is shown as periods LT3*a* to LT3*d*.

First, as the period LT3*a*, the first threshold correction (Vth correction) is performed.

In this case, at the time when the signal line voltage is the threshold correction reference voltage Vofs, the write scanner 13 sets the scan pulse WS to H-level, and the drive scanner 12 sets the power supply pulse DS to the drive voltage Vcc. An equivalent circuit is shown in FIG. 6B. In this case, the anode (node ND2) of the organic EL device 1 serves as a source of the drive transistor Td and a current flows therein. Accordingly, the source node rises with the gate (node ND1) of the drive transistor Td fixed to the threshold correction reference voltage Vofs.

As long as the anode potential (potential of the node ND2) of the organic EL device 1 is equal to or less than (Vcat+Vthe1) (the threshold voltage of the organic EL device 1), the current of the drive transistor Td is used for charging the retention capacity Cs and the capacity Coled. The phrase "as long as the anode potential of the organic EL device 1 is equal to or less than (Vcat+Vthe1)" means that the leak current of the organic EL device 1 is substantially smaller than the current flowing in the drive transistor Td.

Accordingly, the potential of the node ND2 (the source potential of the drive transistor Td) rises with time.

The threshold correction basically refers to an operation of setting the gate-source voltage of the drive transistor Td to the threshold voltage Vth. Therefore, the source potential of the drive transistor Td may be raised until the gate-source voltage of the drive transistor Td becomes the threshold voltage Vth.

However, the gate node may be fixed to the threshold correction reference voltage Vofs only in the period in which the signal line voltage=Vofs. Then, depending on the frame rate or the like, a sufficient time for the source potential to rise until the gate-source voltage reaches the threshold voltage Vth may not be taken by one threshold correction operation. On this account, the threshold correction is performed divisionally at plural times.

Accordingly, the threshold correction as the period LT3*a* is ended before the signal line voltage becomes the video signal voltage Vsig. That is, the write scanner 13 once sets the scan pulse WS to L-level and turns off the sampling transistor Ts.

At this time, both the gate and the source are floated, and a current flows between the drain and the source in response to the gate-source voltage Vgs and bootstrap occurs. That is, as shown in the drawing, the gate potential and the source potential rise.

Next, as the period LT3*b*, the second threshold correction is performed. That is, when the signal line voltage is equal to the threshold correction reference voltage Vofs, the write scanner 13 sets the scan pulse WS to H-level and turns on the sampling transistor Ts again. Thereby, the gate voltage of the drive transistor Td is set to the threshold correction reference voltage Vofs, the source potential is raised again.

Furthermore, the threshold correction operation pauses. Note that the gate-source voltage of the drive transistor Td is closer to the threshold voltage Vth by the second threshold correction, and thus, the amount of bootstrap in the second pause period is smaller than that in the first pause period.

Then, the third threshold correction is performed in the period LT3*c*, after another pause, the fourth threshold correction is performed in the period LT3*d*.

Finally, the gate-source voltage of the drive transistor Td becomes the threshold voltage Vth.

At this time, the source potential (node ND2: anode potential of the organic EL device 1)=(Vofs−Vth)≤(Vcat+Vthe1) (Vcat is the cathode potential and Vthe1 is the threshold voltage of the organic EL device 1).

In the case of FIG. 3, after the period LT3*d* of the fourth threshold correction, the scan pulse WS is set to L-level and the sampling transistor Ts is turned off, and the threshold correction operation is completed.

Here, the example of performing four threshold corrections is shown, however, the number of times of the divisional threshold correction operation is appropriately determined according to the configuration and the operation of the display apparatus, and, for example, may be two, three, five, or more.

Figure 7A:
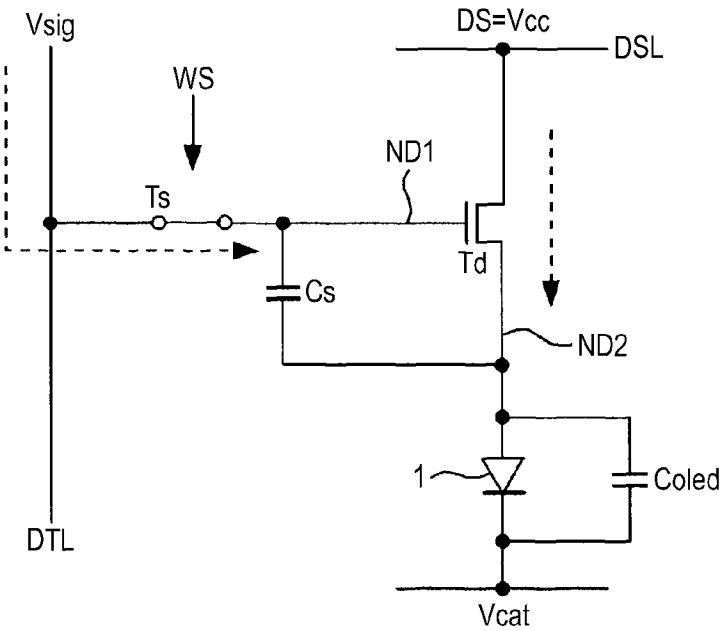
FIGS. 7A and 7B are equivalent circuit diagrams of the process of one cycle of light emission operation of the pixel circuit.

Then, in a period LT 4 in which the signal line voltage is the video signal voltage Vsig, the write scanner 13 sets the scan pulse WS to H-level and writing of the video signal voltage Vsig and mobility correction are performed. That is, the video signal voltage Vsig is input to the gate of the drive transistor Td. An equivalent circuit here is shown in FIG. 7A.

The gate potential of the drive transistor Td is the potential of the video signal voltage Vsig, and a current flows because the power supply control line DSL is at the drive voltage Vcc and the source potential rises with time.

In this regard, if the source voltage of the drive transistor Td is less than the sum of the threshold voltage Vthe1 and the cathode voltage Vcat of the organic EL device 1, the current of the drive transistor Td is used for charging the retention capacity Cs and the capacity Coled. That is, the condition is that the leak current of the organic EL device 1 is significantly smaller than the current flowing in the drive transistor Td.

At this time, the threshold correction operation of the drive transistor Td is completed, and the current flowing in the drive transistor Td reflects the mobility μ.

Specifically, if the mobility is larger, the amount of current at this time is larger and the source rises faster. Contrary, if the mobility is smaller, the amount of current is smaller and the source rises slower.

Thereby, in the period LT4 in which the scan pulse WS is at H-level, after the sampling transistor Ts is turned on, the source voltage Vs of the drive transistor Td rises and, when the sampling transistor Ts is turned off, the source voltage Vs becomes Vs0 reflecting the mobility μ. The gate-source voltage Vgs of the drive transistor Td reflects the mobility and becomes smaller (Vgs=(Vsig−Vs0)), and becomes a voltage that completely corrects the mobility after the laps of a fixed period of time.

Figure 7B:
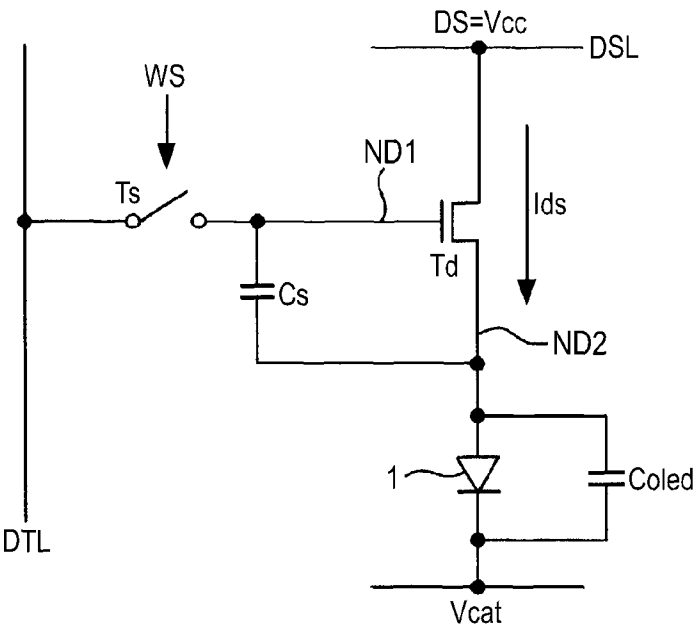

After the writing of the video signal voltage Vsig and the mobility correction are performed in the above described manner, the gate-source voltage Vgs is fixed and the process moves to bootstrap and light emission (period LT5). FIG. 7B shows an equivalent circuit.

That is, the scan pulse WS is set to L-level, the sampling transistor Ts is turned off, the writing is ended, and then, the organic EL device 1 is allowed to emit light. In this case, the current Ids in response to the gate-source voltage Vgs of the drive transistor Td flows in the organic EL device 1, the potential of the node ND2 rises to a voltage VEL at which the current flows, and the organic EL device 1 emits light. At this time, the sampling transistor Ts is off and the gate (node ND1) of the drive transistor Td similarly rises at the same time of the rising of the potential of the node ND2, and thereby, the gate-source voltage Vgs is kept constant (bootstrap operation).

As described above, the pixel circuit 10 includes the threshold correction operation and the mobility correction operation as one cycle of light emission operation in one frame period, and the operation for light emission of the organic EL device 1 is performed.

By the threshold correction operation, the current in response to the signal potential Vsig may be provided to the organic EL device 1 regardless of variations of the threshold voltage Vth of the drive transistor Td in each pixel circuit 10 and the threshold voltage Vth fluctuation due to fluctuation over time. That is, variations of the threshold voltage Vth in manufacturing or due to changes over time may be cancelled and high quality may be maintained without brightness irregularities or the like on the screen.

Further, the drain current also varies due to the mobility of the drive transistor Td and the image quality becomes lower due to variations in mobility of the drive transistor Td with respect to each pixel circuit 10, however, by the mobility correction, the source potential Vs may be obtained in response to the magnitude of the mobility of the drive transistor Td. As a result, the gate-source voltage Vgs is adjusted to absorb the variations in mobility of the drive transistor Td of each pixel circuit 10, and the image quality degradation due to the variations in mobility may be removed.

Furthermore, as one cycle of pixel circuit operation, the threshold correction operation is divided and performed at plural times is on the demand for higher speed (higher frequency) of the display apparatus.

As the frame rate becomes higher, the operation time of the pixel circuit becomes relatively shorter, and it becomes difficult to secure a continuous threshold correction period (the period in which signal line voltage=threshold correction reference voltage Vofs). Accordingly, a necessary period as the threshold correction period is secured by time-divisionally performing the threshold correction operation in the above described manner, and the gate-source voltage of the drive transistor Td is converged on the threshold voltage Vth.

However, as the speed is higher, one threshold correction period in the divisional threshold correction operation becomes shorter. Then, particularly, the threshold correction operation may easily fail with the shorter first threshold correction operation period (LT3*a*).

The explanation will be made with reference to FIG. 4.

Figure 4:
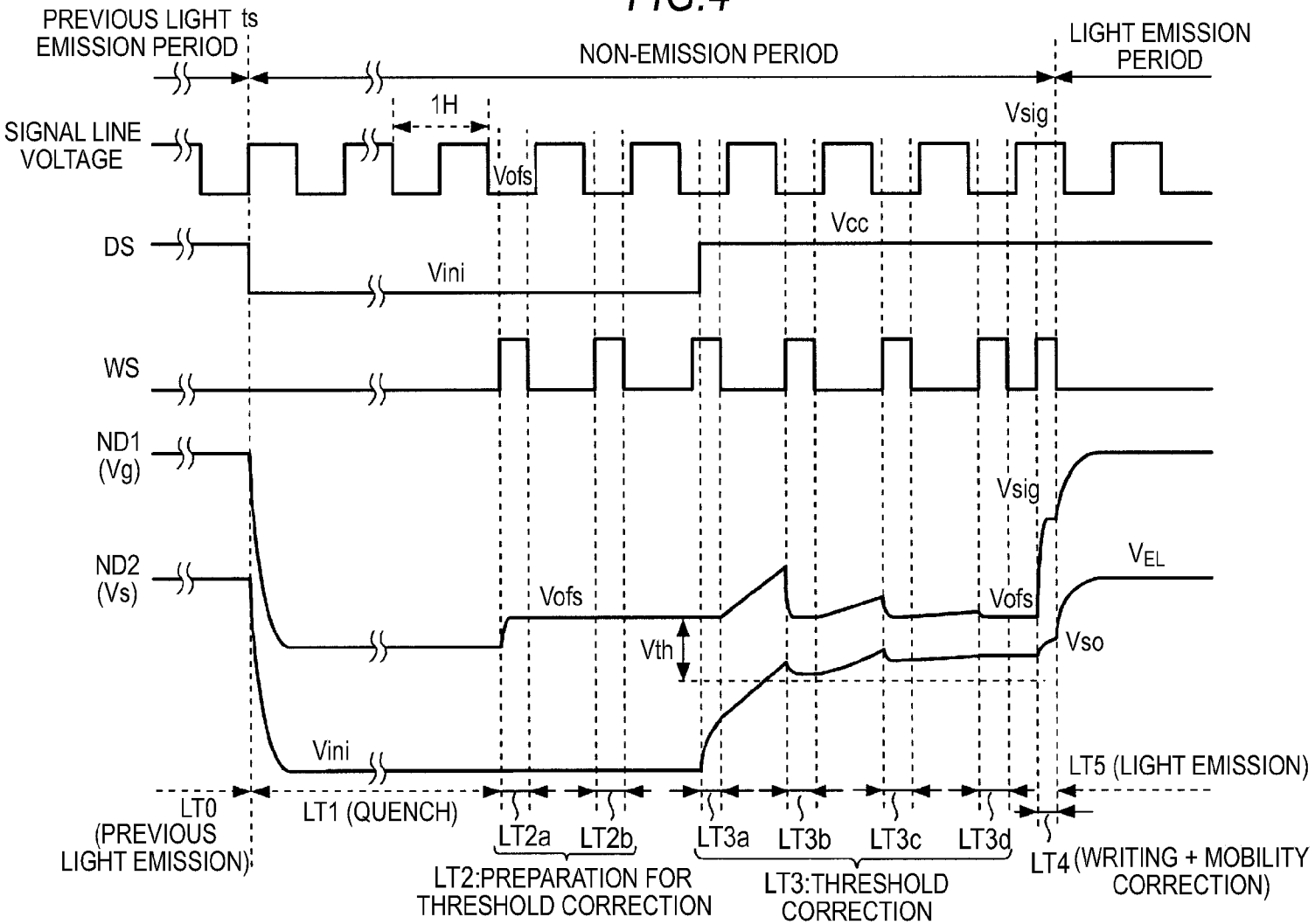
FIG. 4 is an explanatory diagram in the case where a threshold correction operation fails.

It is assumed that the first threshold correction operation period LT3*a* shown in FIG. 4 has the shorter period length, and the amount of rising of the source voltage Vs is relatively small.

Then, at the end of the period LT3*a*, the gate-source voltage Vgs remains relatively larger.

Here, the pause period of the threshold correction operation starts, and the amount of bootstrap here depends on the gate-source voltage Vgs and the mobility μ of the drive transistor Td. That is, the higher the gate-source voltage Vgs or the larger the mobility μ, the faster the bootstrap and the larger the amount of bootstrap in the pause period (that is, rises of the source voltage Vs and the gate voltage Vg).

FIG. 4 shows a state in which the amount of bootstrap becomes excessively larger in the pause period immediately after the period LT3*a*.

Then, when the pause period ends and the second threshold correction is started in the period LT3*b*, the gate voltage Vg is returned to the threshold correction reference voltage Vofs. However, if the rise of the source voltage Vs by the bootstrap in the immediate pause period is excessively larger, as shown in the drawing, the gate-source voltage Vgs may become the threshold voltage Vth or less. The excessive rising refers to the case where the source voltage Vs rises higher than (Vofs−Vth) at the second or subsequent threshold correction operation.

The threshold correction is the operation that sets the gate-source voltage of the drive transistor Td to the threshold voltage Vth as described above. Therefore, if the gate-source voltage becomes the threshold voltage Vth or less before the threshold correction operation is completed, normal threshold correction may be impossible and the threshold correction fails. As a result, as shown in FIG. 4, the process moves to the respective operations of signal writing, mobility correction, and light emission under the condition that the gate-source voltage Vgs is not the threshold voltage Vth, and light is emitted without threshold correction. Accordingly, degradation of image quality is caused.

[3. Pixel Circuit Operation of Embodiment]

Figure 8:
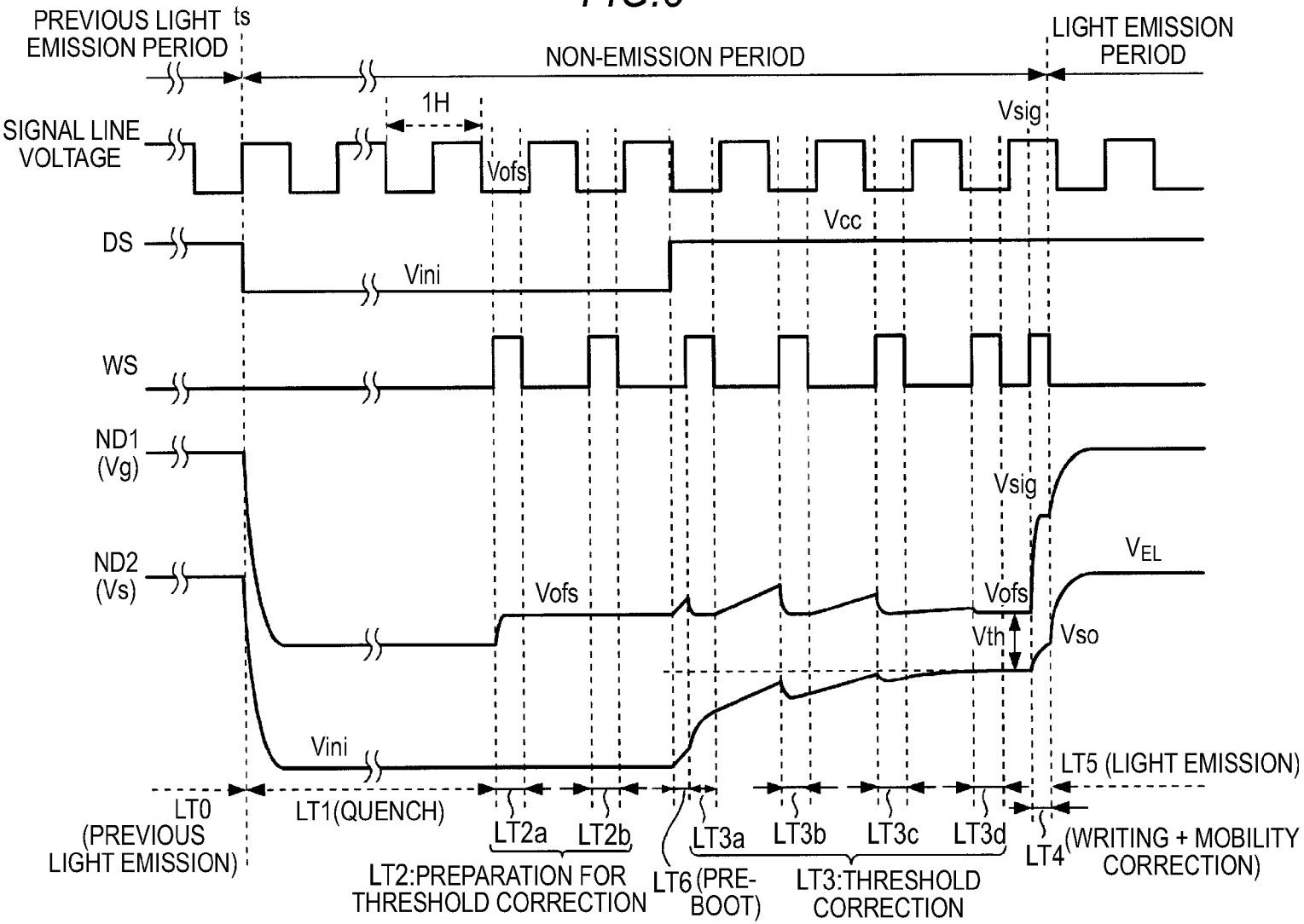
FIG. 8 is an explanatory diagram of an operation of the pixel circuit of the embodiment.

In the embodiment, in order to prevent the failure of the threshold correction, the pixel circuit 10 is operated with driving timing as shown in FIG. 8.

This is to execute pre-bootstrap (hereinafter, referred to as "pre-boot") that raises the source voltage Vs and the gate voltage Vg of the drive transistor Td in a predetermined period (LT5) immediately before the start of the first threshold correction in divisional threshold correction.

FIG. 8 shows a timing chart of one light emission cycle (one frame period) of operation of the pixel circuit 10 like FIG. 3. Like in FIG. 3, the signal line voltage, the power supply pulse, the scan pulse WS, the node ND1 (the gate voltage Vg of the drive transistor Td), and ND2 (the source voltage Vs of the drive transistor Td) are shown.

The driving of the signal line DTL (signal line voltage) by the horizontal selector 11 and the scan pulse WS by the write scanner 13 are the same as those in FIG. 3.

In the case of FIG. 8, the time when the power supply pulse DS by the drive scanner 12 is set to the drive voltage Vcc is different from that in FIG. 3.

The operation of FIG. 8 will be explained. A time point ts in the timing chart of FIG. 8 is start timing of one cycle in which the organic EL device 1 as the light emitting device is driven to emit light, for example, one frame period of image display.

Before the time point ts (period LT0), light emission for the previous frame is performed (as is the case of FIG. 3: an equivalent circuit is shown in FIG. 5A).

At the time point ts, the operation for light emission in this frame is started.

First, the power supply pulse DS is set to the initial potential Vini. In this period, the initial potential Vini is smaller than the sum of the threshold voltage Vthe1 and the cathode voltage Vcat of the organic EL device 1, that is, Vini≤(Vthe1+Vcat), and thus, the organic EL device 1 is quenched and a non-emission period is started. At this time, the power supply control line DSL serves as the source of the drive transistor Td. Further, the anode (node ND2) of the organic EL device 1 is charged to the initial potential Vini. An equivalent circuit is shown in FIG. 5B.

After a fixed period, preparation for threshold correction is made (periods LT2*a*, LT2*b*).

That is, in the periods LT2*a*, LT2*b*, when the potential of the signal line DTL becomes the threshold correction reference voltage Vofs, the scan pulse WS is set to H-level, and the sampling transistor Ts is turned on. Accordingly, the gate (node ND1) of the drive transistor Td is at the threshold correction reference voltage Vofs. Therefore, the gate-source voltage Vgs of the drive transistor Td becomes (Vofs−Vini) (see FIG. 6A).

It may be impossible to perform the threshold correction operation if the (Vofs−Vini) is not larger than the threshold voltage Vth of the drive transistor Td, and thus, the initial potential Vini and the threshold correction reference voltage Vofs are set to satisfy (Vofs−Vini)>Vth.

That is, as preparation of threshold correction, the gate-source voltage of the drive transistor is made sufficiently larger than the threshold voltage Vth.

Subsequently, immediately before the threshold correction (Vth correction) is started, pre-boot is performed as a period LT6.

Figure 9:
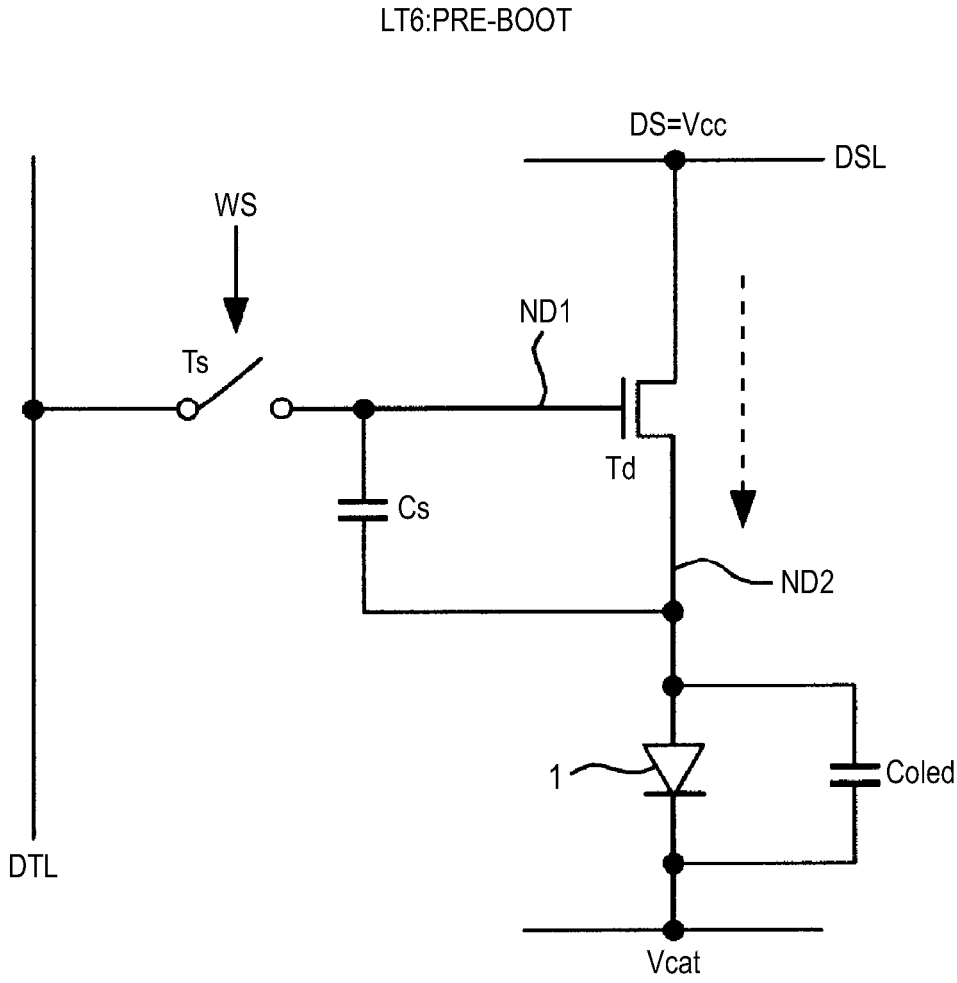
FIG. 9 is an equivalent circuit diagram at pre-boot of the embodiment.

That is, before the scan pulse WS is raised, the drive scanner 12 sets the power supply pulse DS to the drive voltage Vcc. An equivalent circuit is shown in FIG. 9. Here, the node (node ND2) side serves as the source of the drive transistor Td. Then, the gate and the source are floated, and a current flows between the drain and the source in response to the gate-source voltage Vgs and bootstrap occurs. That is, as shown in FIG. 8, the gate voltage Vg and the source voltage Vs rise.

After the pre-boot is performed in this manner, the threshold correction is performed. Here is an example of performing four threshold corrections as periods LT3*a* to LT3*d*.

First, the first threshold correction (Vth correction) is performed as the period (LT3*a*).

In this case, since the drive scanner 12 has set the power supply pulse DS to the drive voltage Vcc, at the time when the signal line voltage is the threshold correction reference voltage Vofs, the write scanner 13 sets the scan pulse WS to H-level, the sampling transistor Ts is turned on, and the threshold correction is started (see FIG. 6B for an equivalent circuit).

Then, subsequently, a current flows between the drain and the source in response to the gate-source voltage Vgs of the drive transistor Td.

Accordingly, the source node rises with the gate (node ND1) of the drive transistor Td fixed to the threshold correction reference voltage Vofs.

As long as the anode potential (the potential of the node ND2) of the organic EL device 1 is (Vcat+Vthe1) (the threshold voltage of the organic EL device 1) or less, the current of the drive transistor Td is used for charging the retention capacity Cs and the capacity Coled. Accordingly, the potential of the node ND2 (the source potential of the drive transistor Td) rises with time.

The threshold correction as the period LT3*a* is ended because the write scanner 13 once sets the scan pulse WS to L-level and turns off the sampling transistor Ts before the signal line voltage becomes the video signal voltage Vsig.

Then, in the subsequent pause period, both the gate and the source are floated, and a current flows between the drain and the source in response to the gate-source voltage Vgs and bootstrap occurs. That is, as shown in the drawing, the gate potential and the source potential rise.

Note that, at the end of the first threshold correction, because the correction is performed after the source voltage Vs is raised to some degree by immediate pre-boot, even when the threshold correction period length as the period LT3*a* is short, the gate-source voltage Vgs appropriately becomes smaller at the threshold voltage Vth or more.

Accordingly, in the pause period after the first threshold correction, the amount of bootstrap is relatively suppressed.

Next, as the period LT3*b*, the second threshold correction is performed. That is, when the signal line voltage is equal to the threshold correction reference voltage Vofs, the write scanner 13 sets the scan pulse WS to H-level and turns on the sampling transistor Ts again.

Further, the threshold correction operation pauses. Note that the gate-source voltage of the drive transistor Td is closer to the threshold voltage Vth by the second threshold correction, and thus, the amount of bootstrap in the second pause period is smaller than that in the first pause period.

Furthermore, the third threshold correction is performed in the period LT3*c*, after another pause, the fourth threshold correction is performed in the period LT3*d*.

After the period LT3*d* of the fourth threshold correction, the scan pulse WS is set to L-level and the sampling transistor Ts is turned off, and the threshold correction operation is completed.

By the fourth threshold correction, finally, the gate-source voltage of the drive transistor Td becomes the threshold voltage Vth. That is, the total threshold correction time for the four corrections is set so that the gate-source voltage Vgs of the drive transistor Td reaches the threshold voltage Vth.

Then, in the period LT4 in which the signal line voltage is the video signal voltage Vsig, the write scanner 13 sets the scan pulse WS to the H-level, and writing of the video signal voltage Vsig and mobility correction are performed. That is, the video signal voltage Vsig is input to the gate of the drive transistor Td (see FIG. 7A for an equivalent circuit).

The gate potential of the drive transistor Td is the potential of the video signal voltage Vsig, and a current flows because the power supply control line DSL is at the drive voltage Vcc and the source potential rises with time.

At this time, if the source voltage of the drive transistor Td is less than the sum of the threshold voltage Vthe1 and the cathode voltage Vcat of the organic EL device 1, the current of the drive transistor Td is used for charging the retention capacity Cs and the capacity Coled. Further, the current flowing in the drive transistor Td reflects the mobility μ.

That is, if the mobility is larger, the amount of current at this time is larger and the source rises faster. Contrary, if the mobility is smaller, the amount of current is smaller and the source rises slower. Thereby, in the period LT4 in which the scan pulse WS is at the H-level, after the sampling transistor Ts is turned on, the source voltage Vs of the drive transistor Td rises and, when the sampling transistor Ts is turned off, the source voltage Vs becomes Vs0 reflecting the mobility μ. The gate-source voltage Vgs of the drive transistor Td reflects the mobility and becomes smaller (Vgs=(Vsig−Vs0)), and becomes a voltage that completely corrects the mobility after a fixed time elapses.

After the writing of the video signal voltage Vsig and the mobility correction are performed in the above described manner, the gate-source voltage Vgs is fixed and the process moves to bootstrap and light emission (period LT5).

That is, the scan pulse WS is set to L-level, the sampling transistor Ts is turned off, the writing is ended, and then, the organic EL device 1 is allowed to emit light (see FIG. 7B for an equivalent circuit).

In this case, the current Ids in response to the gate-source voltage Vgs of the drive transistor Td flows, the potential of the node ND2 rises to a voltage VEL at which the current flows, and the organic EL device 1 emits light. At this time, the sampling transistor Ts is off and the gate (node ND1) of the drive transistor Td similarly rises at the same time of the rising of the potential of the node ND2, and thereby, the gate-source voltage Vgs is kept constant (bootstrap operation).

As described above, the pixel circuit 10 includes the threshold correction operation and the mobility correction operation as one cycle of light emission operation in one frame period, and the operation for light emission of the organic EL device 1 is performed.

As described above, the embodiment is characterized in that pre-boot is performed in the period LT6 immediately before the first threshold correction in the period LT3*a*.

The pre-boot is performed by setting power supply pulse DS=drive voltage Vcc by the drive scanner 12 before the sampling transistor Ts is turned on by the scan pulse WS.

By the pre-boot, the first threshold correction is started with the gate voltage Vg fixed to the threshold correction reference voltage Vofs under the condition that the source voltage Vs is raised to some degree. That is, at the start of the first threshold correction, the gate-source voltage Vgs of the drive transistor Td has already been made appropriately smaller.

Accordingly, even when the threshold correction period LT3*a* is short in terms of time, at the end of the first threshold correction, the gate-source voltage Vgs has been appropriately smaller. Thereby, even if the mobility μ of the drive transistor Td is high, the amount of bootstrap in the pause period after the first threshold correction is suppressed.

As a result, the phenomenon that the amount of bootstrap is excessively larger, the rise of the source voltage Vs becomes excessively larger, and the gate-source voltage Vgs becomes the threshold voltage Vth or less at the second or subsequent threshold correction may be prevented.

Particularly, in the pixel circuit in which the mobility μ is higher and the speed of the bootstrap is higher, the rise of the source voltage Vs at pre-boot is larger. Therefore, in the pixel circuit in which the amount of pre-boot in the subsequent pause period is larger, the gate-source voltage Vgs at the end of the first threshold correction also becomes smaller, and, as a result, the amount of boot strap in the pause period becomes smaller. In other words, negative feedback is applied in advance in response to the speed of the bootstrap with respect to each pixel circuit 10.

On this account, in the pixel circuit 10 in which there is a higher possibility that the threshold correction operation fails, the amount of bootstrap in the pause period may further be suppressed and the failure of the threshold correction operation may further be prevented.

As described above, in the embodiment, in the system of performing plural threshold correction operations, the phenomenon that the gate-source voltage of the drive transistor becomes smaller than the threshold voltage due to the boot strap and the threshold correction operation fails may be prevented. Thereby, also, in the case of the faster driving at the driving speed many times higher or the like, the margin of threshold correction may be enlarged and both speeding up and improvements in image quality by realization of appropriate threshold correction operation may be balanced.

The embodiment has been explained above, however, the invention is not limited to the examples.

In the examples, four threshold corrections are performed within one light emission cycle, however, the number of times of the divisional threshold correction operation is appropriately determined according to the configuration and the operation of the display apparatus, and, for example, may be two, three, five, or more.

Further, the predetermined period length as the pre-boot period LT6 may be determined in a range in which the threshold correction operation does not fail according to the number of threshold corrections and the respective voltage settings. If the pre-boot period is too long, the source voltage Vs becomes (Vofs−Vth) or more contrary, the threshold correction operation may fail. Thus, it is obvious that the period length of pre-boot should be set not to be too long.

The present application contains subject matter related to that disclosed in Japanese Priority Patent Application JP 2010-005964 filed in the Japan Patent Office on Jan. 14, 2010, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An apparatus comprising:

a pixel array in which pixel circuits are arranged in a matrix, each pixel circuit having (a) a light emitting device, (b) a drive transistor that applies a current in response to a gate-source voltage to the light emitting device, (c) a retention capacity that provides an input potential to the drive transistor and holds the input potential dependent on a threshold voltage of the drive transistor and an input video signal voltage, and (d) a sampling transistor that inputs a signal line voltage to the retention capacity;

a signal selector that supplies threshold correction reference voltages and the video signal voltages as the signal line voltages to respective signal lines arranged in columns on the pixel array;

a drive control scanner that provides power control pulses to respective power supply control lines arranged in rows on the pixel array and applies drive voltages to the drive transistors of the pixel circuits; and a write scanner that provides scan pulses to respective write control lines arranged in rows on the pixel array to control the sampling transistors of the pixel circuits and executes input of the threshold correction reference voltages and the video signal voltages to the respective pixel circuits, and brings the sampling transistors into conduction by the scan pulses at plural times when the signal line voltages are the threshold correction reference voltages in order to execute plural threshold corrections in non-emission periods of one light emission cycles of the respective pixels circuits, wherein, pre-bootstrap that raises the input potential is executed in a predetermined period before start of the first threshold correction in the plural threshold corrections, the predetermined period starts when the drive control scanner applies the drive voltage by way of the power control pulse and ends when the write scanner brings the sampling transistor into conduction by way of the scan pulse for the first threshold correction, and the predetermined period is shorter than half of a horizontal period of the signal line voltage and shorter than a period for executing the first threshold correction in the plural threshold corrections.

2. A method for driving a display apparatus including: (a) a pixel array in which pixel circuits are arranged in a matrix, each pixel circuit having (i) a light emitting device, (ii) a drive transistor that applies a current in response to a gate-source voltage to the light emitting device, (iii) a retention capacity that provides an input potential to the drive transistor and holds the input potential dependent on a threshold voltage of the drive transistor and an input video signal voltage, and (iv) a sampling transistor that inputs a signal line voltage to the retention capacity; (b) a signal selector that supplies threshold correction reference voltages and the video signal voltages as the signal line voltages to respective signal lines arranged in columns on the pixel array; (c) a drive control scanner that provides power control pulses to respective power supply control lines arranged in rows on the pixel array and applies drive voltages to the drive transistors of the pixel circuits; and (d) a write scanner that provides scan pulses to respective write control lines arranged in rows on the pixel array and controls the sampling transistors of the pixel circuits and executes input of the threshold correction reference voltages and the video signal voltages to the respective pixel circuits, the method comprising the steps of:

bringing the sampling transistors into conduction by the scan pulses at plural times using the write scanner when the signal line voltages are the threshold correction reference voltages in order to execute plural threshold corrections in non-emission periods of one light emission cycles of the respective pixels circuits; and executing pre-bootstrap that raises the input potential in a predetermined period before start of the first threshold correction in the plural threshold corrections, wherein, the predetermined period starts when the drive control scanner applies the drive voltage by way of the power control pulse and ends when the write scanner brings the sampling transistor into conduction by way of the scan pulse for the first threshold correction, and the predetermined period is shorter than half of a horizontal period of the signal line voltage and shorter than a period for executing the first threshold correction in the plural threshold corrections.

3. The apparatus of claim 1, wherein the source voltage has a larger rise in the predetermined period with respect to the pre-bootstrap when a mobility of the drive transistor is higher.

4. The method of claim 2, wherein the source voltage has a larger rise in the predetermined period with respect to the pre-bootstrap when a mobility of the drive transistor is higher.

5. The method of claim 2, wherein the pre-bootstrap is executed by the drive control scanner applying the drive voltage in the predetermined period before the write scanner brings the sampling transistor into conduction by the scan pulse for the first threshold correction.

* * * * *